US006688233B1

(12) United States Patent
Manole et al.

(10) Patent No.: US 6,688,233 B1
(45) Date of Patent: Feb. 10, 2004

(54) SYSTEM AND METHOD FOR EFFECTING MECHANICAL TRANSLATION OF PROJECTILES IN CASED TELESCOPED AMMUNITION USING SMART MATERIAL

(75) Inventors: Leon Manole, Great Meadows, NJ (US); Stewart Gilman, Budd Lake, NJ (US); Ernest Logsdon, Newton, NJ (US); Samuel A. Lafontaine, Paterson, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/249,608

(22) Filed: Apr. 23, 2003

Related U.S. Application Data

(60) Provisional application No. 60/319,692, filed on Nov. 13, 2002, and provisional application No. 60/319,572, filed on Sep. 24, 2002.

(51) Int. Cl.[7] ..... F42S 5/184

(52) U.S. Cl. ..... 102/437; 102/434; 102/293

(58) Field of Search ..... 102/437, 434

(56) References Cited

U.S. PATENT DOCUMENTS 4,493,664 A * 1/1985 Dale ..... 441/7
4,715,284 A * 12/1987 Hendry et al. ..... 102/434
4,759,293 A * 7/1988 Davis, Jr. ..... 102/520
5,196,650 A * 3/1993 Cytron ..... 102/521
5,388,522 A * 2/1995 Martwick et al. ..... 102/434
6,321,656 B1 * 11/2001 Johnson ..... 102/377
6,557,650 B2 * 5/2003 Fayard et al. ..... 175/4.59
6,581,522 B1 * 6/2003 Julien et al. ..... 102/431

* cited by examiner

*Primary Examiner*—Charles T. Jordan
*Assistant Examiner*—Bret Hayes
(74) *Attorney, Agent, or Firm*—Michael C. Sachs; John F. Moran

(57) ABSTRACT

A system and method for improving the process of mechanical translation of projectiles by a spring mechanism that is built of a smart material and that is activated by an electric pulse, to provide a controlled translation of a projectile before firing or, in case of pre-firing termination, in order to restore the projectile to its original position after translation. The pre-firing translation using the spring mechanism provides a more controlled process and reduces the risk associated with the conventional propulsion charge translation design. The ability to return the projectile to its initial state after translation affords a significant advantage over the conventional propulsion charge design since it enables the projectile firing to be terminated even after translation, unlike in the conventional design whereby the projectile firing is irreversible upon a mechanical translation by setting off the propulsion charge.

28 Claims, 16 Drawing Sheets

SYSTEM AND METHOD FOR EFFECTING MECHANICAL TRANSLATION OF PROJECTILES IN CASED TELESCOPED AMMUNITION USING SMART MATERIAL

CROSS REFERENCE TO RELATED APPLICATIONS

This application claims the benefit under 35 USC 119e of U.S. provisional patent application serial No. 60/319572 filed on Sep. 24, 2002, and Ser. No. 60/319,692 filed Nov. 13, 2002 which application is expressly incorporated by reference.

FEDERAL RESEARCH STATEMENT

The invention described herein may be manufactured and used by or for the Government of the United States for governmental purposes without the payment of any royalties thereon.

BACKGROUND OF INVENTION

Ammunition is an essential part of the arsenals of the Armed Forces. A vast array of different types of ammunition are currently in use in the Armed Forces. Conventional ammunition refers to ammunition whereby the projectile is held by and partly extends from the cartridge case. Another type of ammunition is termed Cased Telescoped Ammunition (CTA).

In general, CTA is comprised of individual rounds containing a projectile, fitted inside a cartridge case with seals at both ends, held by an internal steel or composite sleeve. The sleeve itself is internal to the CTA cartridge case and is attached to the front seal by threads. Furthermore, it is designed to prevent the projectile from unwanted movement and also to maintain a necessary alignment with the gun tube once the CTA is fully chambered in the gun.

CTA is being developed by the US Army for use in rapid auto-loader small, medium and large caliber systems up 120 mm range. Presently, a 105-mm CTA is being developed for use in the 105-mm Multi-Role Armament Ammunition System (MRAAS). The term CTA therefore comes from the projectile being telescoped back into the cartridge case. Thus, the CTA ammunition resembles a cylindrical article that houses the projectile, sleeve, and energetics (propellant and primer) internally, hence hidden from view. In contrast, a conventional ammunition is discernible by the aft seal, cartridge case and most of the projectile. Similar to CTA, the energetics are stored inside the cartridge case.

A unique benefit can be provided to both conventional and CTA ammunition by translating the projectile in the gun just before the main propellant charge goes off. Translation means that the projectile is moved or moving just before the main propellant charge provides the energy to fire the projectile from the gun. In brief, the translation process is a mechanism whereby the projectile is displaced a small distance forward in the gun before the main propulsion charge ignites.

The translation affords the projectile a number of advantages. One such advantage is that the projectile is set in motion momentarily before the main propulsion charge ignites, thus reducing the recoiling action of the gun and the setback force on the projectile. Consequently, the impulsive stress on the projectile significantly decreases, thereby improving the performance margin by allowing less robust projectiles to survive gun launch. As a result, the projectile can be made lighter using less robust designs. A lighter projectile will have a higher velocity, and for Kinetic Energy (KE) rounds it will enhance its ability to defeat the target.

Moreover, for ammunition with very high propellant density pack and/or large projectile volume to propellant volume space, high differential pressure waves can occur during propellant ignition. These high differential pressure waves can increase the pressure to dangerous levels that may damage the projectile or the gun. Translation may correct this problem by moving the projectile and correcting the density and volume problem. By translating the projectile, the ullage volume increases, thereby reducing the amplitude of the pressure wave.

Typically, the conventional translation process can be accomplished by an energetic means utilizing a secondary propulsion charge or propellant pre-charge as part of the propulsion system. The secondary propulsion charge is set off, generating a sufficient gas pressure to propel the projectile forward. After a short timing delay following the ignition of the secondary propulsion charge, the main propulsion charge is then ignited, resulting in an ensuing ballistic event of the projectile as it continues to travel along the gun tube and out of the gun to target.

While the conventional propulsion translation design provides the translation objective, such a design involving a dual propulsion charge system is usually difficult to achieve and furthermore presents some risks in maintaining the correct timing. If the timing is too long, then the projectile will travel too far down the tube. Consequently, the propellant gases from the main charge will not impart enough velocity on the projectile to defeat its target. Conversely, if the timing is too short, then the secondary and main charge may go off nearly at the same time, thereby creating a large pressure wave that may damage the projectile or gun.

Another disadvantage with the conventional design using the energetic translation method is that the process is irreversible. Once the secondary propulsion charge is ignited, a ballistic event is eventual and committal. In some cases when a pre-firing termination is commanded, this energetic translation method is not an enabling technology.

Thus, there remains an unsatisfied need for an improved design of a translation process or mechanism for use in conventional and CTA ammunition. Preferably, the enhanced translation design should be easy to achieve in field operation and does not present a risk due to the timing factor. Moreover, the enhanced translation design should be reversible to allow the projectile to return to its initial state after translation in an event of a pre-firing termination.

SUMMARY OF INVENTION

It is a feature of the present invention to provide an improved design method for achieving a translation process for the projectiles of small, medium and large caliber ammunition including both conventional and CTA. The improved method of translation embodied in the present invention utilizes a spring mechanism built of smart material as part of a mechanism to translate the projectiles.

These smart materials are materials that may be trained to change shape at certain temperatures or when electricity is passed through. They are known as shape memory alloys. Exemplary materials are Nitinol (Nickel-Titanium) and CAN (Copper-Aluminum-Nickel). They can be trained to change to a particular shape at a set temperature or applied current and change back to the original shape. The shape change takes place almost instantaneously and with substantial force to accomplish the work needed to translate a projectile or work a mechanism to translate the projectile. In addition, since they can return to the original shape as needed, the projectiles may be moved back to their pre-translated position if needed. Shape memory alloys have been known to be able change shape thousands of times without loss of properties and ability to do work.

The present invention provides numerous other features, among which are the following:

1. A shape-memory alloy, such as Nitinol, is used for the spring mechanism. The shape-memory alloy retains the information of the spring undeflected state even after undergoing a deflection.
2. For translation of a CTA projectile, the spring mechanism is attached between the steel sleeve on the cartridge housing and the CTA projectile.
3. For translation of a conventional projectile, the spring mechanism is attached between the rear of the projectile and the aft seal at the rear of the cartridge. This same mechanism is also applicable to a CTA projectile.
4. The spring is initially compressed. Upon electrically activating the shape-memory spring mechanism, the spring expands to translate the projectile forward for both the conventional and CTA projectiles.
5. In an event that a pre-firing termination is ordered, an electric charge activates the shape-memory spring mechanism to return it to the initial compressed state, thus restoring the position of the CTA projectile to its non-translated state.
6. Upon firing, the high pressure causes the spring mechanism to separate from the projectile and sleeve or aft seal (case base and seal), and travel up the gun tube and be expelled without interference to the projectile.

The improved method of translation of the present invention affords significant advantages over the conventional design in that the translation mechanism is simple and does not require a propulsion charge, which eliminates the potential risks due to incorrect timing. More importantly, the shape-memory material utilized in the improved translation method of the present invention permits a projectile firing to be terminated before a ballistic event.

BRIEF DESCRIPTION OF DRAWINGS

The features of the present invention and the manner of attaining them, will become apparent, and the invention itself will be understood by reference to the following description and the accompanying drawings, wherein.

Similar numerals in the drawings refer to similar elements. It should be understood that the sizes of the different components in the figures might not be in exact proportion, and are shown for visual clarity and for the purpose of explanation.

DETAILED DESCRIPTION

Figure 1:
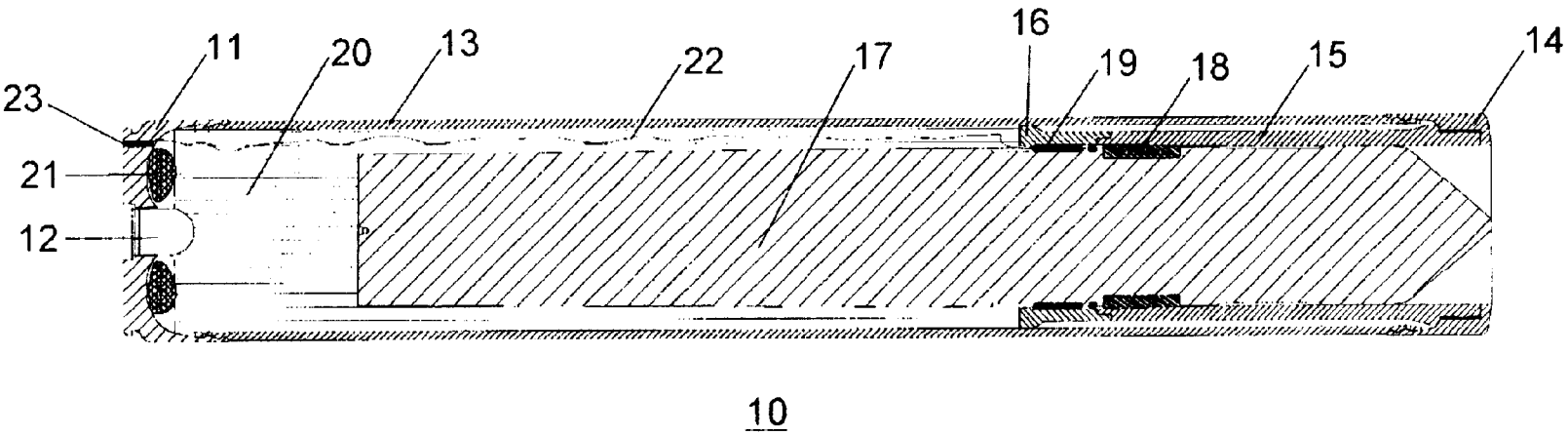
FIG. 1 is a cutaway view of a CTA cartridge comprising of a CTA projectile and a smart material translation spring mechanism, made according to a preferred embodiment of the present invention, shown prior to a translation of the CTA projectile

With reference to FIG. 1, a Cased Telescoped Ammunition (CTA) cartridge 10 made according to a preferred embodiment of the present invention is generally comprised of an aft seal 11, primer 12, cartridge case 13, front seal 14, front sleeve 15, aft sleeve 16, projectile 17, obturator 18, translation spring mechanism 19, propellant 20, propellant bag charge 21, low voltage control wire 22 and control wire link 23. Each of these major components is further described as follows: The projectile 17 is constructed of metal or composite material of various shapes (usually cylindrical) that is either a solid or a tactical projectile containing explosives or other lethal cargo. The translation spring mechanism 19 is constructed of a smart material, such as nitinol, and is attached to the projectile 17, metal or composite aft sleeve 16, and the control wire 22.

The metal or composite aft sleeve 16 is threaded into the metal or composite front sleeve 15, which in turn is threaded into the metal front seal 14. The projectile 17 is held in the front sleeve 15 by the plastic obturator 18. The composite or combustible cartridge case 13 snaps into the metal front seal 14 and aft seal 11.

The Propellant 20, propellant bag charge 21 control wire 22, projectile 17, translation spring mechanism 19, obturator 18, front and aft sleeve 16 and 15 are all internal to the cartridge case 13, front and aft seal 14 and 11, respectively.

A primer 12 is threaded into the aft seal 11. The metal control wire link 23 is threaded into the aft seal 11 and is attached to the control wire 22 before the aft seal is snapped onto the case 13. The assembly of the CTA is detailed in the FIGS. 4–7 that follow.

Figure 2:
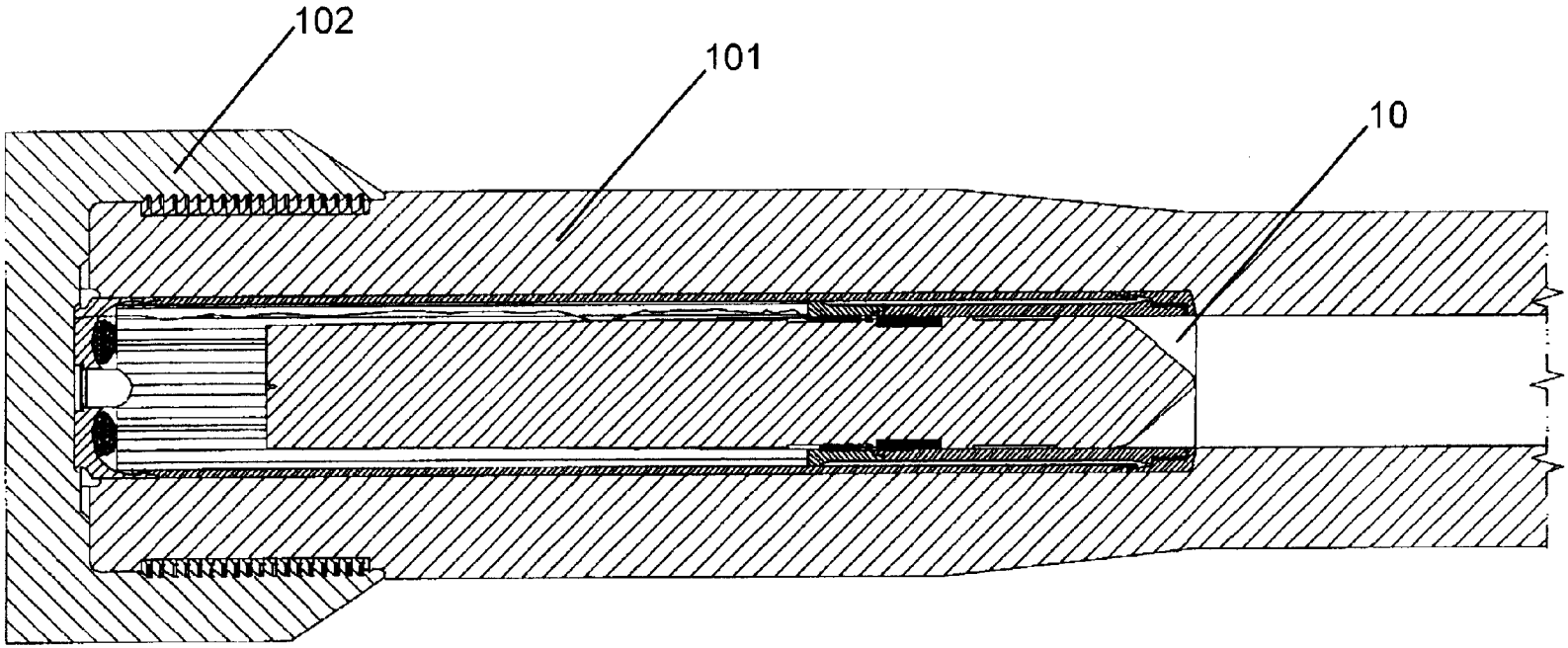
FIG. 2 is a cutaway view showing the CTA cartridge of FIG. 1 loaded into the gun.

FIG. 2 shows the CTA cartridge 10 loaded into the gun tube 101 with a closed breech 102.

Figure 3:
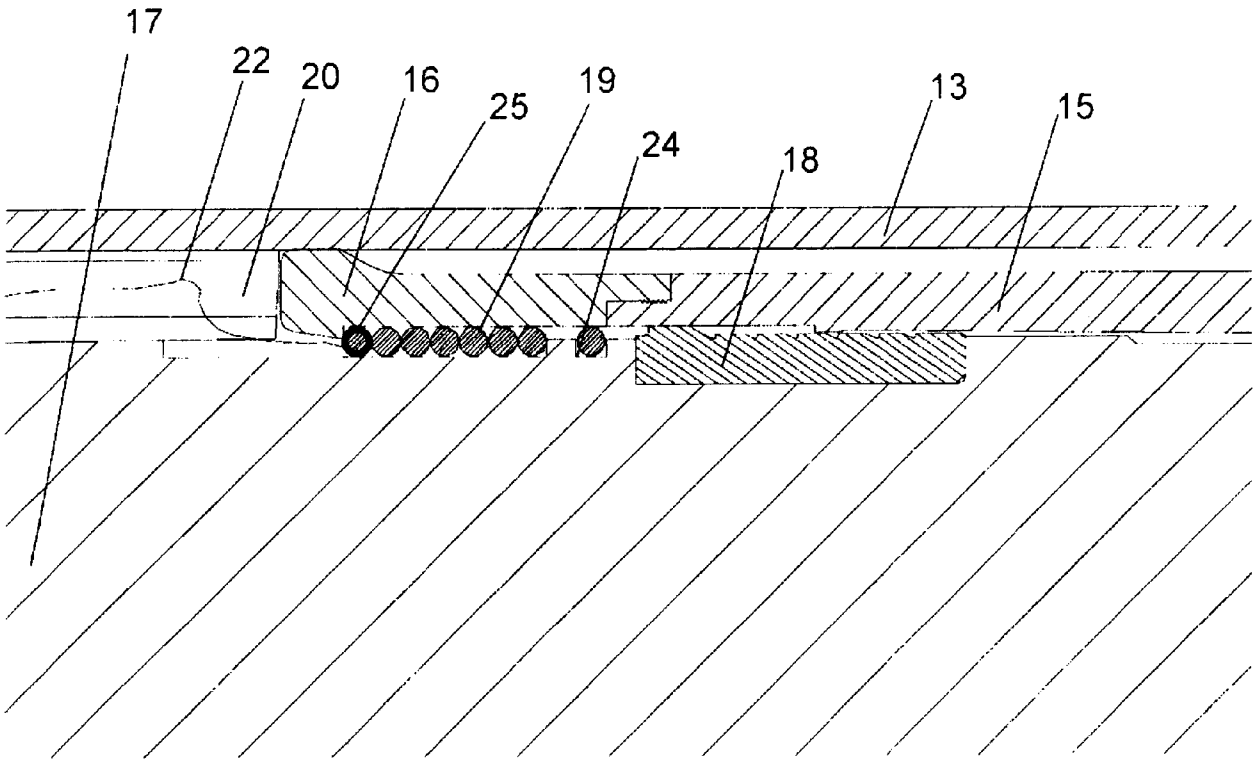
FIG. 3 is a cutaway view of the translation spring mechanism of FIG. 1 and shows how the spring is attached to the projectile, aft sleeve and low voltage activation wire.

FIG. 3 shows how the spring 19 is attached to the projectile 17 by means of a groove 24 in the projectile 17. The spring 19 is attached to the rear sleeve 16 and the low voltage control wire 22 by an epoxy layer 25.

Figure 4:
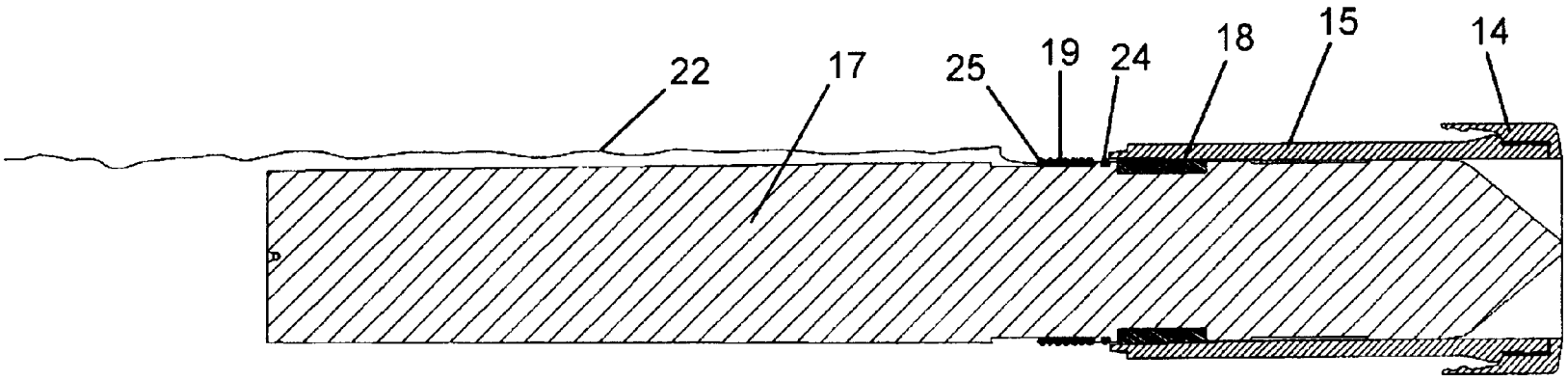
FIG. 4 is a cutaway view of the projectile, with the translation spring mechanism, loaded into the front seal/sleeve assembly without the rear part of the sleeve, a low voltage activation wire attached to the spring and subsequently to the aft seal for controlling the smart spring.

FIG. 4 illustrates the first step in the assembly of the CTA cartridge 10 with the translation spring mechanism 19. The front sleeve 15 is threaded into the front seal 14. The translation spring mechanism 19 and obturator 18 are then attached to projectile 17. The obturator 18 is pressed on until it goes into a seat (not shown) on the projectile 17. Thereafter, the spring 19 is slipped onto the projectile until the front of the spring 19 is in the groove 24 in the projectile 17. The projectile 17 is then pressed into the forward sleeve 15 until the obturator 18 snaps into a groove in the sleeve (not shown). The assembly is now complete and the low voltage control wire 22 is attached with the epoxy 25 to rear of the spring 19.

Figure 5:
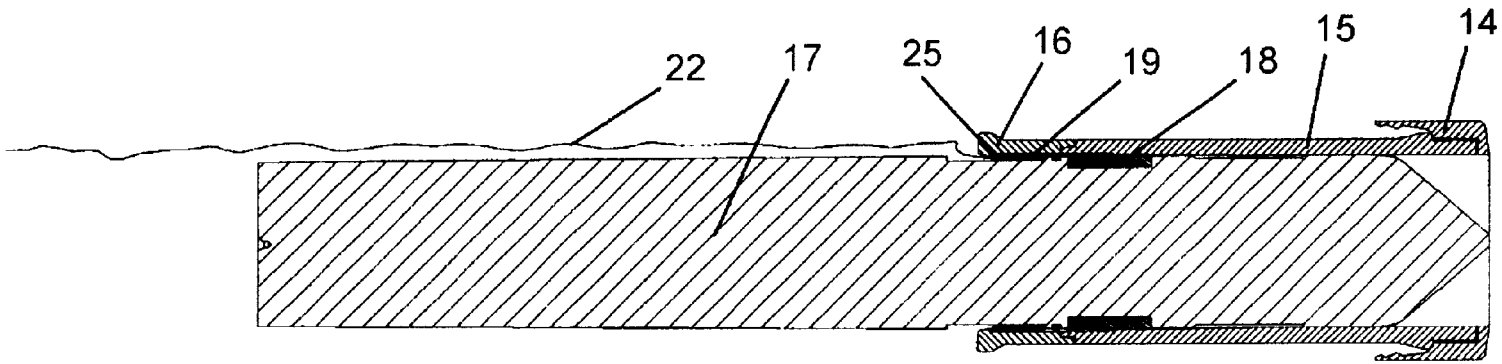
FIG. 5 is a cutaway view showing the activation wire and containing the components of FIG. 4 with the aft sleeve attached to the front sleeve by threads.
Figure 6:
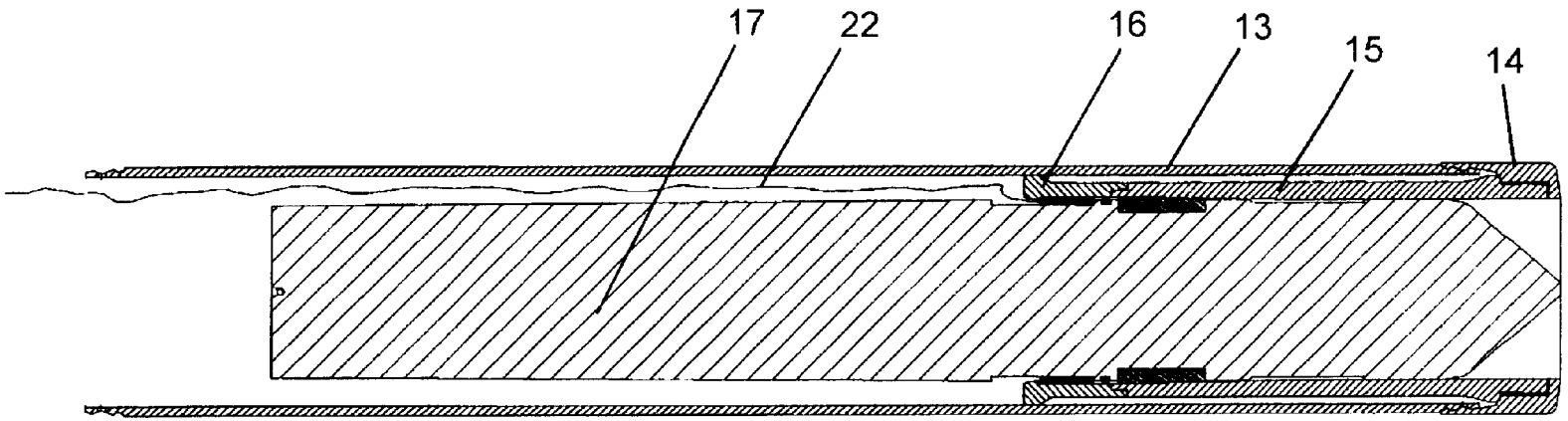
FIG. 6 is a cutaway view of the cartridge case attached to the components of FIG. 5.

FIG. 5 illustrates the second step in the assembly of the CTA cartridge 10 with the spring translation mechanism 19. The aft sleeve 16 has the epoxy 25 applied to a position where the rear part of the spring 19 would be in contact. The aft sleeve 16 is then threaded onto the front sleeve 15. This would allow the back of the spring 19 to be anchored to the aft sleeve 16 and attached to the control wire 22 FIG. 6 illustrates the third step in the assembly of the CTA cartridge 10. The cartridge case 13 is pressed onto and snaps onto the front seal 14. The two surfaces have matching grooves that allow them to snap together. The projectile 17, aft sleeve 16, front sleeve 15 and wire 22 are now all internal to the cartridge case 13 and front seal 14.

Figure 7B:
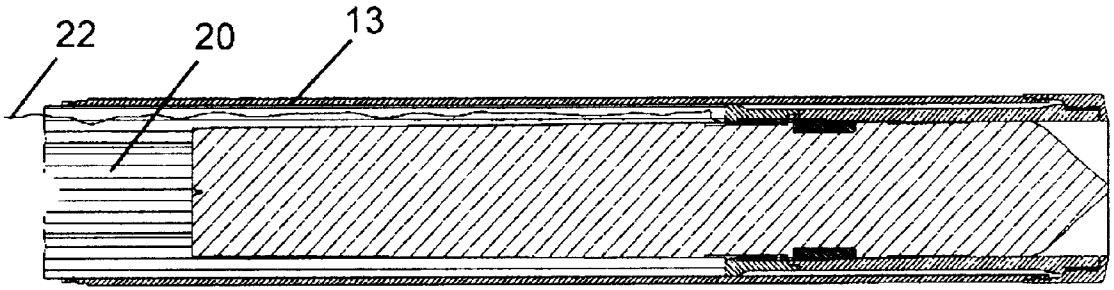
FIG. 7 is comprised of FIGS. 7A and 7B, and represents a partly exploded cutaway view of the components of FIG. 6 with the propellant added and the rear seal assembled with the primer and propellant bag charge to form the cartridge of FIG. 1 containing the translation spring assembly by snapping these assemblies together with the activation wire attached to the aft seal.
Figure 7A:
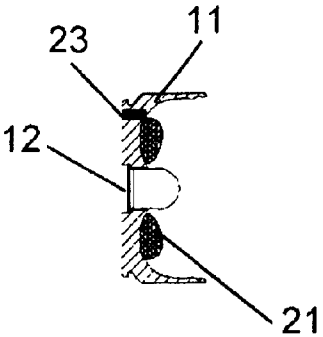

FIG. 7 shows the final step in the assembly of the CTA cartridge 10. Propellant 20 is added to the cartridge case 13. The propellant bag charge 21 is glued or attached to the aft seal 11. The primer 12 is threaded into the aft seal 11. The wire 22 is pulled through a hole in the aft seal 11 and attached to the control wire link 23. The control wire link 23 is then threaded into the aft seal 11. The aft seal 11 is now pressed onto the cartridge case 13 and snaps together as a complete CTA cartridge 10 as shown in FIG. 1.

Figure 8:
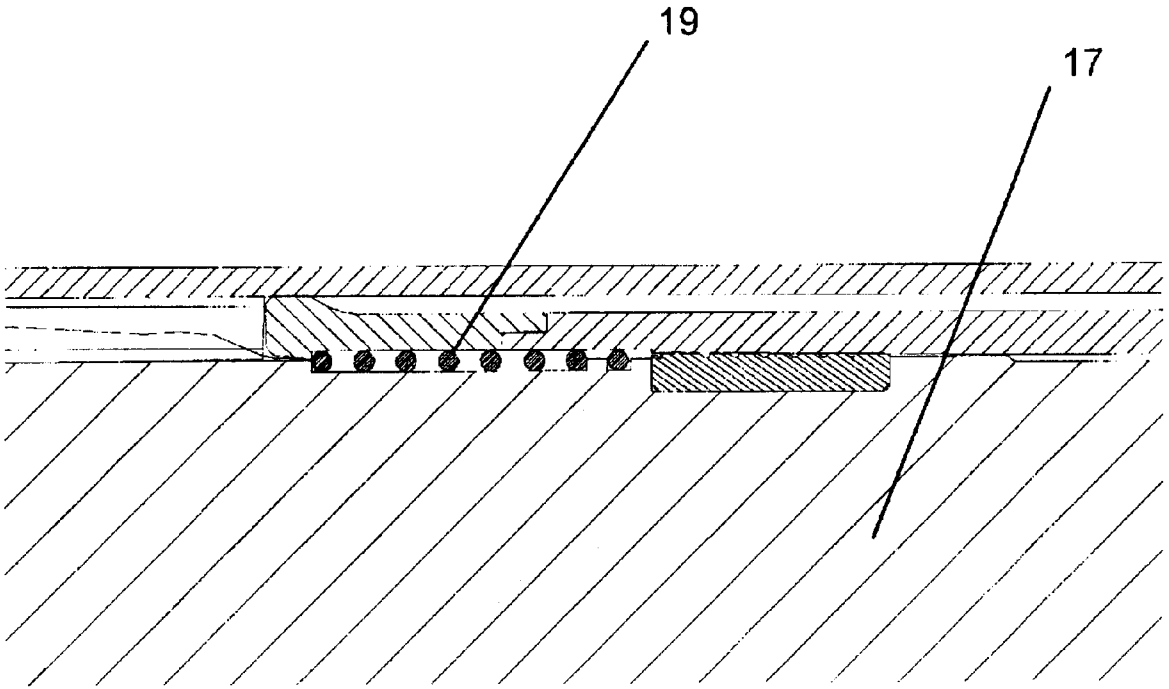
FIG. 8 is a cutaway view of the translation spring mechanism activated. This may be compared with FIG. 3 showing the translation spring before activation.

FIG. 8 shows the spring 19 activated and expanded which moves the projectile 17 forward.

Figure 9:
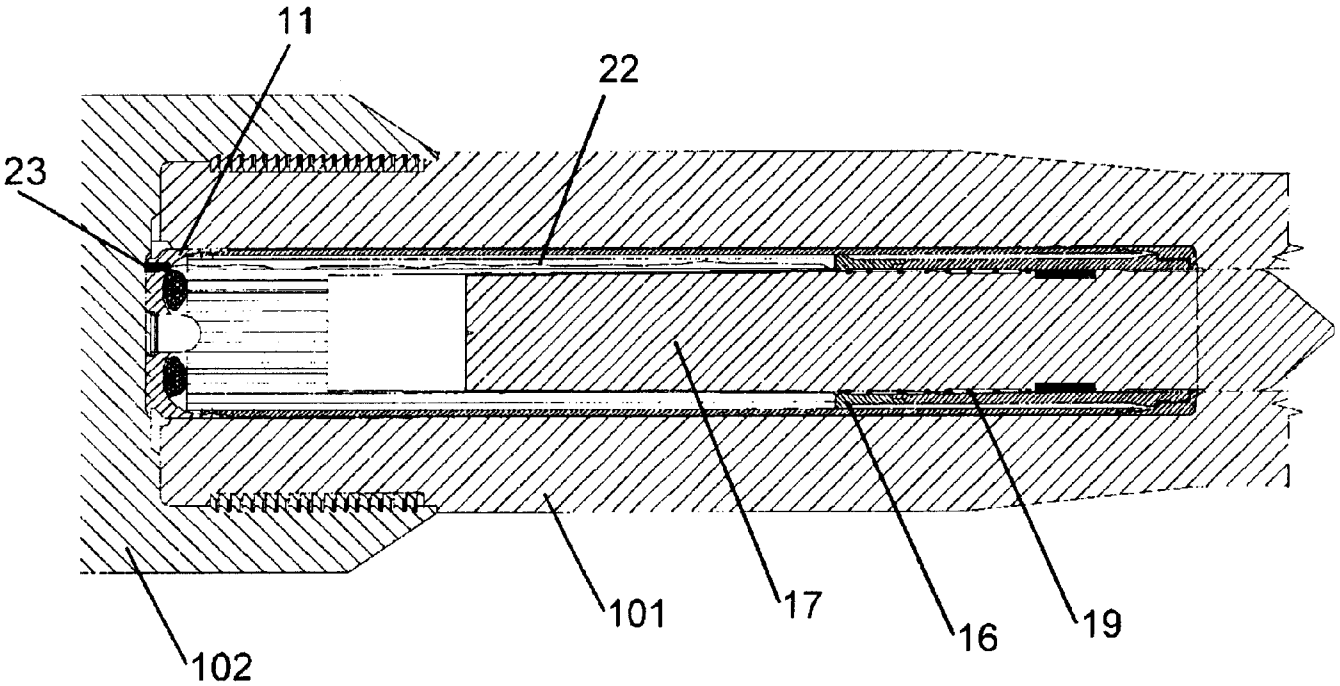
FIG. 9 is a cutaway view of the CTA cartridge loaded in the gun showing the translation of the projectile into the gun tube upon activation of the translation spring mechanism.

FIG. 9 shows the CTA cartridge 10 in the gun with the translation spring mechanism 19 activated and the projectile 17 translated into the gun tube 101. This may be compared with FIG. 2 that shows the spring 19 not activated and projectile 17 not translated.

The translation spring mechanism 19 is activated by low voltage electricity that comes through the control wire link 23 in the aft seal 11 and then through the wire 22 to the spring 19. The voltage activates the spring 19 to expand and move the projectile 17 forward causing projectile translation into the gun tube. If a second voltage is sent, the spring 19, which is secured to the aft sleeve 16 and the projectile 17, will compress and pull the projectile back to its pre-translated state shown in FIG. 2.

Figure 10:
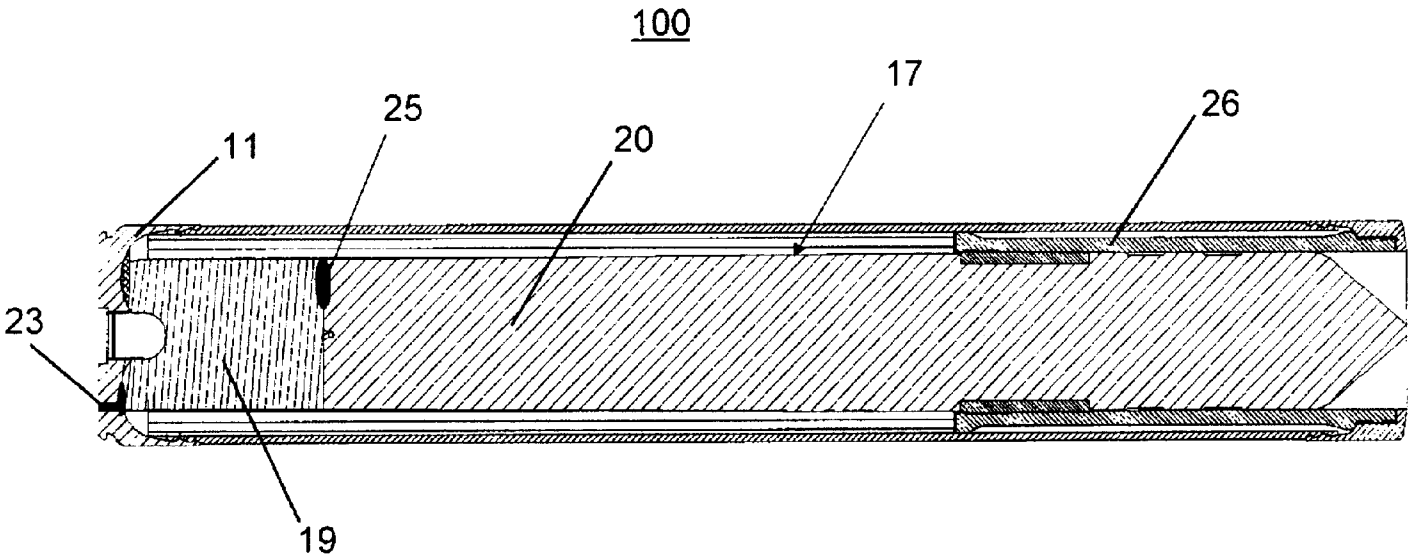
FIG. 10 is a cutaway view of the CTA cartridge with the translation spring mechanism in an alternate location, wherein the spring is attached to the rear of the projectile and the aft seal.

FIG. 10 shows an alternate translation spring mechanism 19 location for the CTA cartridge 100. The spring 19 is placed between the aft seal 11 and the projectile 17. The spring 19 is attached by the epoxy 25 to the rear of the projectile 17 and to the control link 23 in the aft seal 11. The loading of this CTA cartridge 100 is the same as that of the CTA cartridge 10, except the spring 19 is not placed in the sleeve 26 but is attached to the projectile 17 by the epoxy 25.

The sleeve 26 is made of an integral, single-unit construction without the control wire 22. After loading the propellant 20, the epoxy layer 25 is applied on the back and front of the spring 19 that contacts the aft seal 11 and projectile 17. Thereafter, the aft seal 11 is snapped onto the case. The spring 19 is now attached by the epoxy 25 to the aft seal 11 and projectile 17. The epoxy 25 is applied on the inside of the control wire link 23 thread in the aft seal 11 and contacts the spring 19. The control wire link 23 is threaded into the aft seal 11 and is now affixed by the epoxy 25 to the rear of the spring19.

Figure 11:
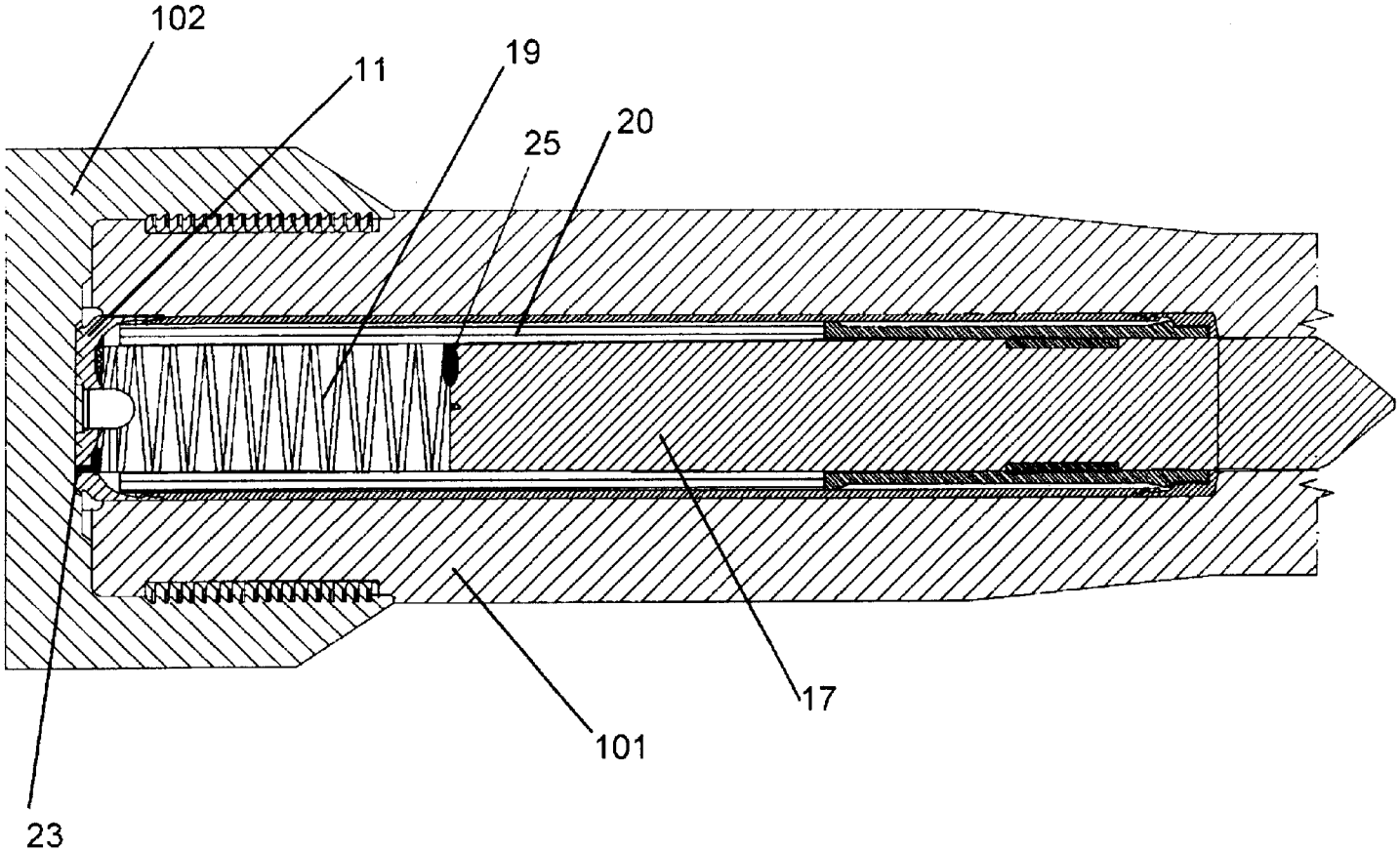
FIG. 11 is a cutaway view of the CTA cartridge of FIG. 10 with the spring mechanism activated and the projectile translated into the gun tube.

FIG. 11 shows the spring 19 in the alternate location activated to translate the projectile 17 into the gun tube 101. The propellant 20 may or may not be placed inside the spring 19 but is not shown here for clarity sake. The spring 19 is activated as before by low voltage electricity passing from the control wire link 23 to the spring 19. If a second voltage is sent, the spring 19, which is secured by the epoxy 25 to the aft seal 11 and the projectile 17, will compress and pull the projectile back to the pre-translated state, as shown in FIG. 10.

Figure 12:
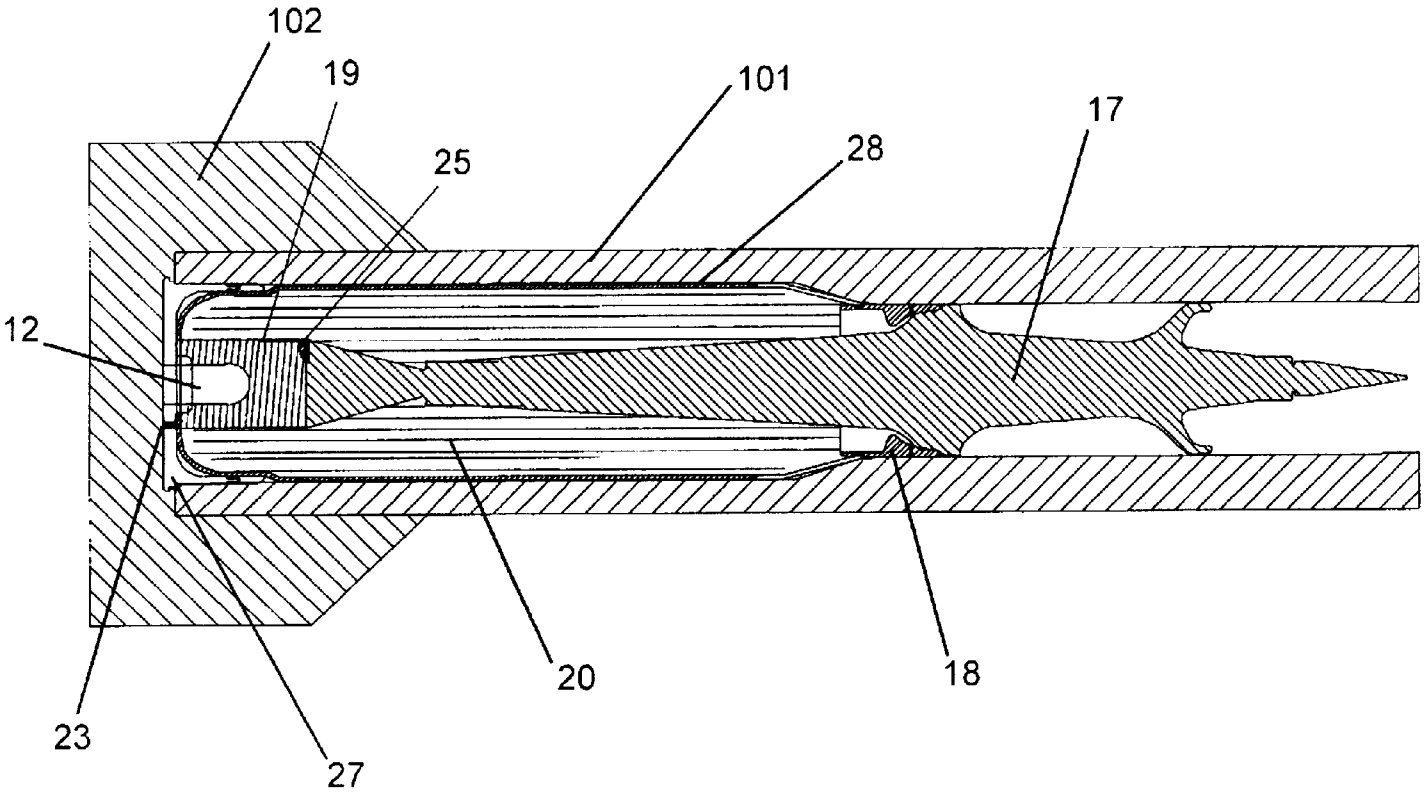
FIG. 12 is a cutaway view of a conventional ammunition cartridge, loaded into the gun, with the spring translation mechanism attached to the rear of the projectile and the case base.

FIG. 12 illustrates the use of the translation spring mechanism 19 on conventional ammunition, which is loaded into a gun 101 with a closed breech 102. The translation spring mechanism 19 is attached to the rear of the projectile by the epoxy 25 and the case base and seal 27 also by the epoxy layer 25.

The conventional ammunition with the translation spring mechanism 19 of the present invention can be built as follows: The obturator 18 is snapped onto the projectile 17. A case adapter 29 is snapped onto the obturator 18. The propellant 20 is attached to the projectile 17 by tape to the outer row of propellant sticks 20. The spring 19 is attached by the epoxy 25 to the rear of the projectile 17. The primer 12 is then threaded into the case base and seal 27.

A cartridge case 28 is snapped into the case base and seal 27. The epoxy 25 is applied to the rear of the spring 19. The case 28 is slid over the propellant 20 and glued to the case adapter 29. The control wire link 23 is then threaded into the case base and seal 27 and makes contact with the spring 19.

Figure 13:
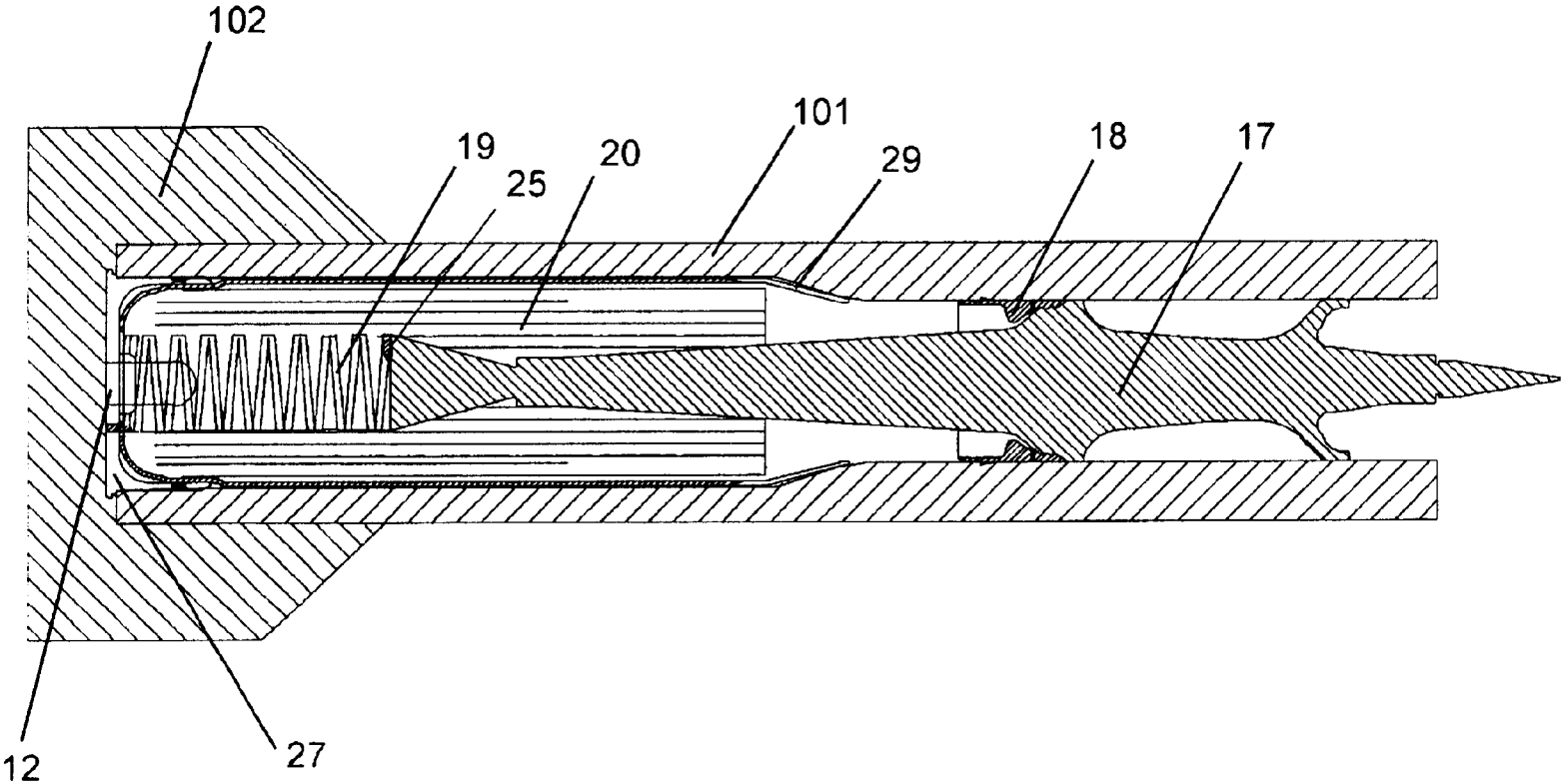
FIG. 13 is a cutaway view of a conventional ammunition cartridge with the spring translation mechanism activated and the projectile translated into the gun tube.

FIG. 13 shows the spring 19 activated on conventional ammunition and the projectile 17 translated into the gun tube 101. The spring 19 is activated as before by low voltage electricity passing from the control wire link 23 to the spring 19. If a second voltage is sent, the spring 19, which is secured to the case base and seal 27 and the projectile 17 by the epoxy 25, will compress and pull the projectile 17 back to the pre-translated state shown in FIG. 12.

Figure 14:
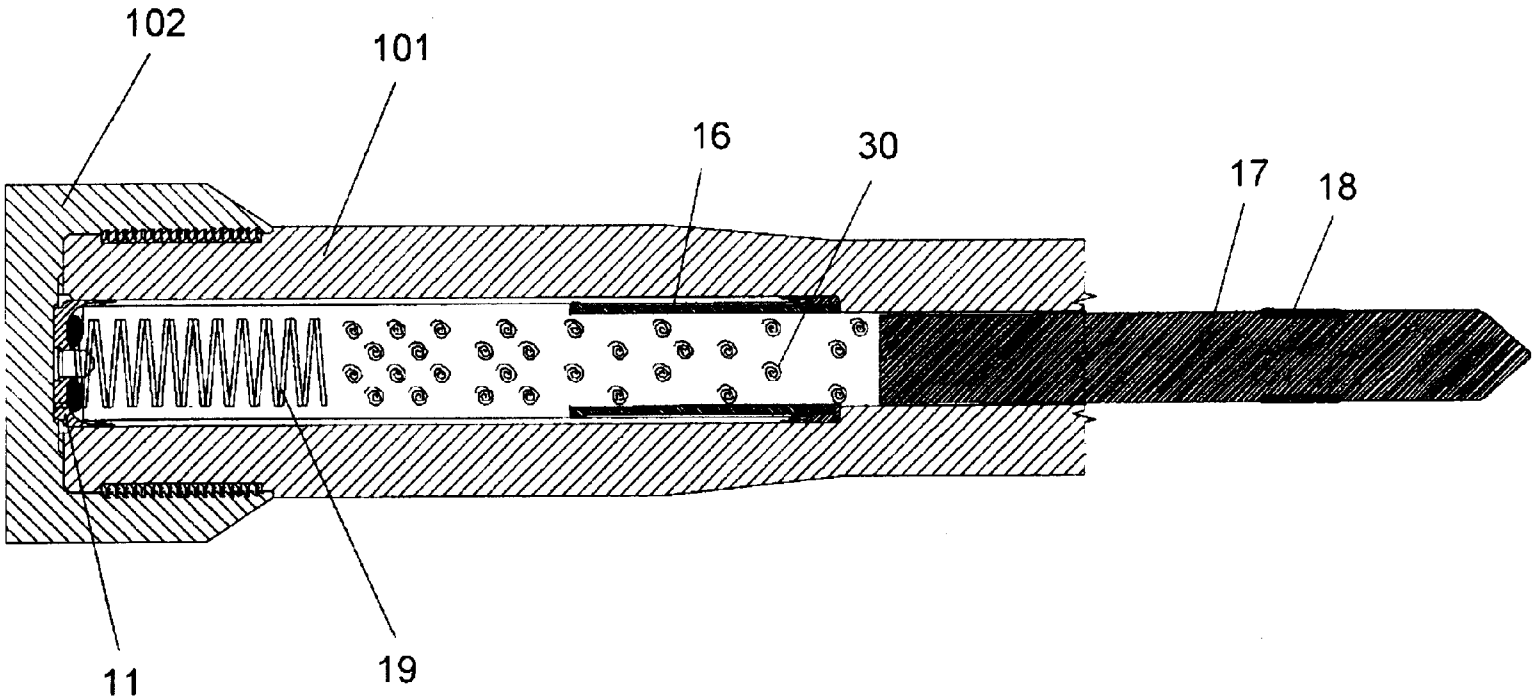
FIG. 14 illustrates the launch of the CTA projectile in the gun, upon an ignition of the propulsion charge following the translation by the spring mechanism as shown in FIG. 9.

FIG. 14 illustrates the CTA projectile 17 traveling up the gun tube 101 after the translation by the spring 19 and the propellant 20 being ignited to form high pressure gases 30. The propellant gases 30 propel the projectile 17 down and out of the gun tube 101. The spring 19 either remains attached to aft sleeve 16 or the aft seal 11 (depending on the spring 19 location) or is broken into pieces and exits out of the gun tube 101 after the projectile 17 exits the gun tube 101. The plastic obturator 18 usually breaks up into pieces as the projectile 17 travels down-range.

Figure 15:
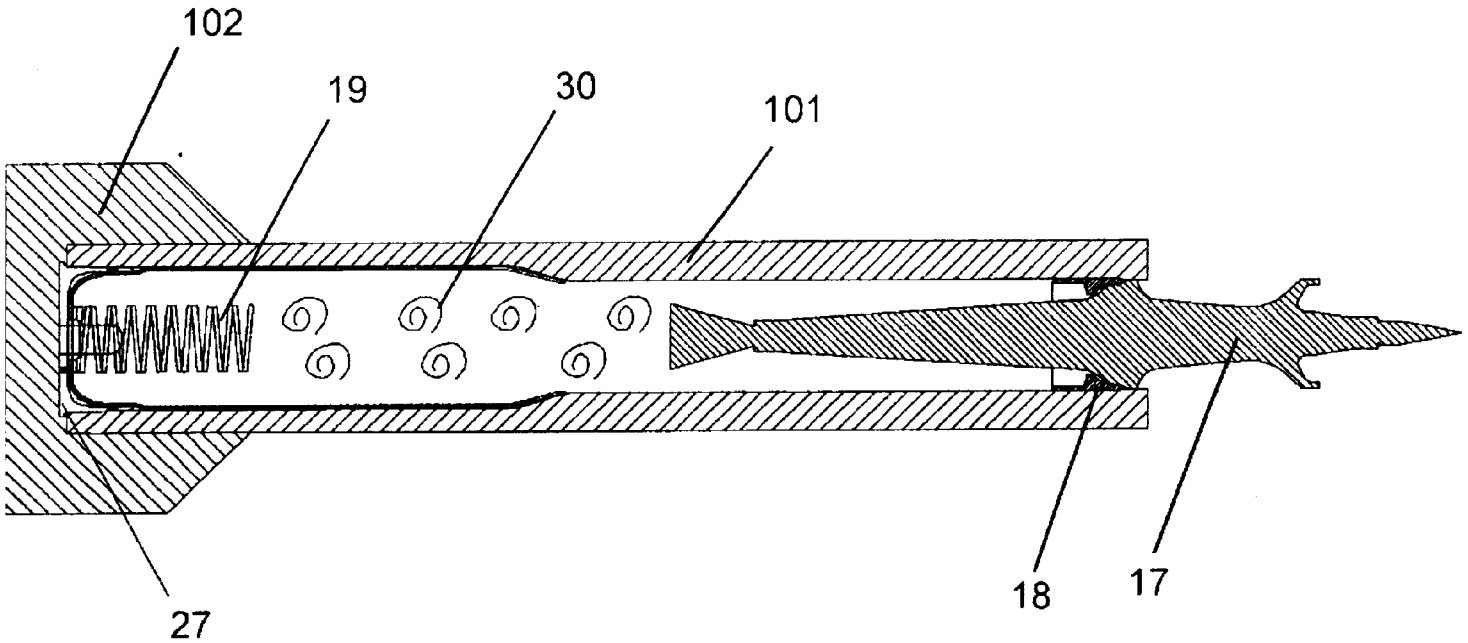
FIG. 15 illustrates the launch of the conventional projectile in the gun, upon an ignition of the propulsion charge following the translation by the spring mechanism as was shown in FIG. 13.

FIG. 15 illustrates the conventional ammunition projectile 17 traveling up the gun tube 101 after the translation by the spring 19 and the propellant 20 being ignited and turned into high pressure propellant gases 30. The propellant gases 30 propel the projectile 17 down and out of the gun tube 101. The spring 19 either remains attached to case base and seal 27 or is broken into pieces and exits out of the gun tube 101 after the projectile 17 leaves the gun tube 101. The obturator 18 breaks up into pieces as the projectile 17 travels downrange.

Figure 16:
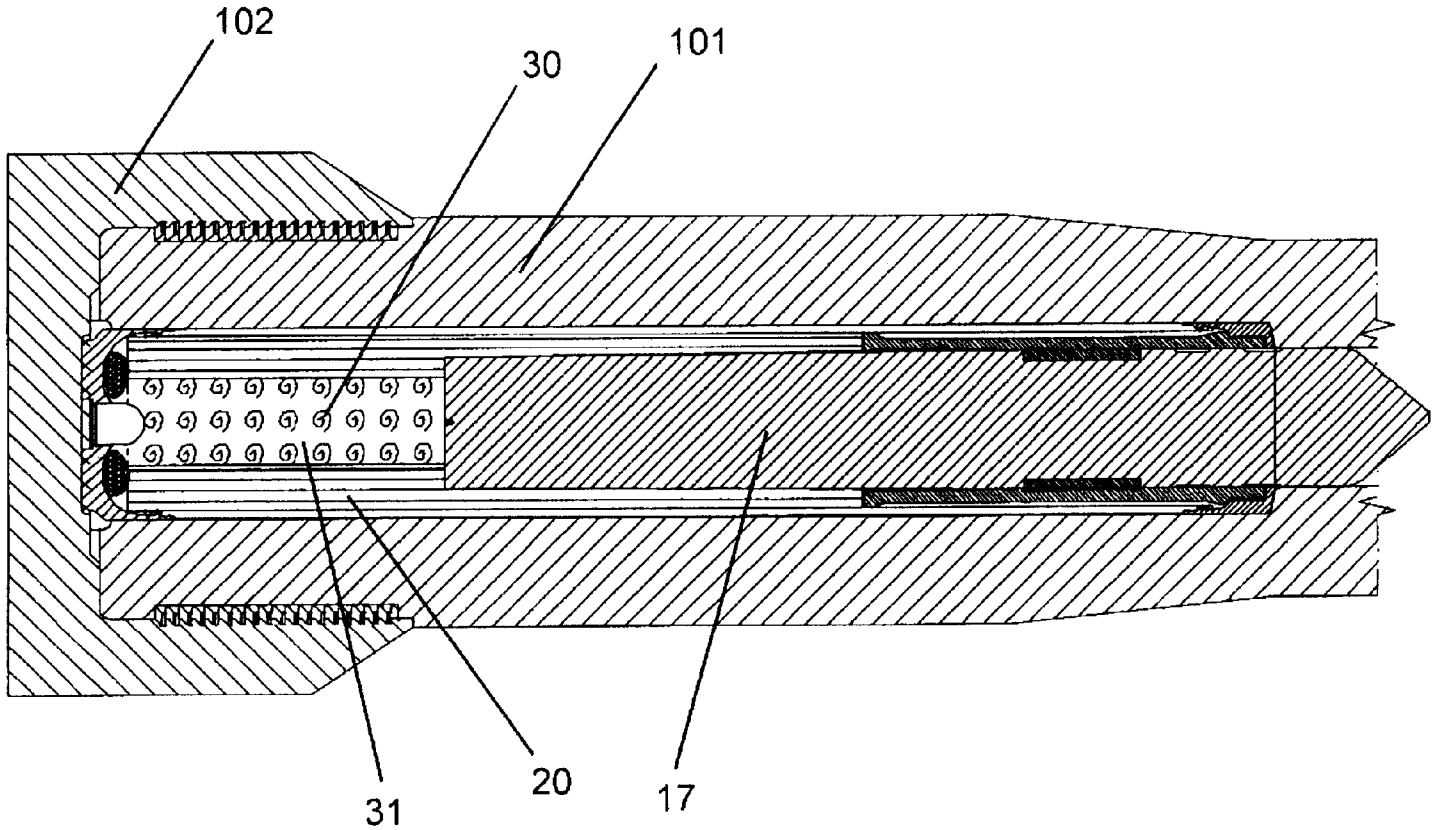
FIG. 16 illustrates how conventional translation of the projectile is done using a propellant pre-charge that is ignited before the main propellant charge.

FIG.16 illustrates how a conventional translation works using a propellant pre-charge 31 for translation of the projectile 17 and the regular propellant 20 to continue the motion of the projectile 17 out of the gun tube 101 to its intended target. The propellant pre-charge 31 is placed behind the projectile 17 as shown in FIG. 16. Upon ignition, only this pre-charge 31 burns and turns into high pressure gases 30 for translating the projectile 17.

Should the pre-charge 31 gases 30 ignite the propellant 20 before the projectile 17 has translated, the pressure of propellant gas 20 may exceed the pressure limit of the gun tube 101, thus posing as a safety issue.

As shown in FIG. 16, a CTA cartridge 10 was used for purposes of illustration. A conventional cartridge 100 would make no difference to the illustration since both have the pre-translation charge 31 behind the projectile 17 and the functioning of translation and safety issues are the same for the CTA 10 or conventional cartridge 100. Once the propellant 20 is properly ignited, after the translation has taken place, FIGS. 14 and 15 illustrate the projectile 17 traveling down the gun tube for the CTA 10 and conventional ammunition 100.

It should be understood that the geometry, compositions, and dimensions of the elements described or illustrated herein can be modified within the scope of the invention and are not intended to be the exclusive; rather, they can be modified within the scope of the invention. Other modifications can be made when implementing the invention for a particular environment.

What is claimed is:

1. A munition comprising:

a projectile;

a cartridge case that houses the projectile;

a translation mechanism placed in contact with the projectile, that causes the projectile to translate from the cartridge case to a gun chamber; and the translation mechanism comprising a shape memory alloy mechanism that controllably and mechanically moves the projectile in a generally translational movement from the cartridge case into the gun chamber.

2. The munition of claim 1, wherein the shape memory alloy mechanism comprises a spring mechanism.

3. The munition of claim 2, wherein the spring mechanism provides a controlled translation of the projection before firing.

4. The munition of claim 2, wherein the spring mechanism provides a controlled translation of the projection after firing.

5. The munition of claim 4, wherein the spring mechanism permits the projectile to be restored to an original position after the translational movement started.

6. The munition of claim 4, wherein the spring mechanism permits the projectile to be retracted in case of pre-firing termination.

7. The munition of claim 2, wherein the spring mechanism is made of a smart material.

8. The munition of claim 5, wherein the spring mechanism is activated by an electric current.

9. The munition of claim 5, wherein the spring mechanism is activated by an electric voltage.

10. The munition of claim 5, wherein the spring mechanism is activated by an electric energy.

11. The munition of claim 7, wherein the smart material is comprised of a Nickel-Titanium alloy.

12. The munition of claim 7, wherein the smart material is comprised of a Copper-Aluminum-Nickel alloy.

13. The munition of claim 1, wherein the translation mechanism separates from the projectile upon firing.

14. A translation mechanism for use with a projectile that is housed within a cartridge case, the translation mechanism comprising:

prior to firing, the translation mechanism is in contact with the projectile to cause the projectile to translate from the cartridge case to a gun chamber upon firing; and the translation mechanism comprises a shape memory alloy mechanism that controllably and mechanically moves the projectile in a generally translational movement from the cartridge case into the gun chamber.

15. The translation mechanism of claim 14, wherein the shape memory alloy mechanism comprises a spring mechanism.

16. The translation mechanism of claim 15, wherein the spring mechanism provides a controlled translation of the projection before firing.

17. The translation mechanism of claim 15, wherein the spring mechanism provides a controlled translation of the projection after firing.

18. The translation mechanism of claim 17, wherein the spring mechanism permits the projectile to be restored to an original position after the translational movement started.

19. The translation mechanism of claim 17, wherein the spring mechanism permits the projectile to be retracted in case of pre-firing termination.

20. The translation mechanism of claim 15, wherein the spring mechanism is made of a smart material.

21. The translation mechanism of claim 18, wherein the spring mechanism is activated by an electric current.

22. The translation mechanism of claim 18, wherein the spring mechanism is activated by an electric voltage.

23. The translation mechanism of claim 18, wherein the spring mechanism is activated by an electric energy.

24. The translation mechanism of claim 20, wherein the smart material is comprised of a Nickel-Titanium alloy.

25. The translation mechanism of claim 20, wherein the smart material is comprised of a Copper-Aluminum-Nickel alloy.

26. The translation mechanism of claim 14, wherein the translation mechanism separates from the projectile upon firing.

27. The translation mechanism of claim 14 that abuts against the projectile prior to firing.

28. The translation mechanism of claim 14 that abuts against a rear portion of the projectile prior to firing.

* * * * *